US007071808B2

(12) United States Patent
Nakamura

(10) Patent No.: US 7,071,808 B2
(45) Date of Patent: Jul. 4, 2006

(54) FUSIBLE LINK UNIT

(75) Inventor: Goro Nakamura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 140 days.

(21) Appl. No.: 10/674,548

(22) Filed: Oct. 1, 2003

(65) Prior Publication Data

US 2004/0124963 A1 Jul. 1, 2004

(30) Foreign Application Priority Data

Oct. 2, 2002 (JP) ..... P2002-289716

(51) Int. Cl.
*H01H 85/20* (2006.01)
*H01H 85/175* (2006.01)

(52) U.S. Cl. ..... 337/256; 337/198; 361/837

(58) Field of Classification Search ..... 337/256, 337/293, 295, 297, 161, 227, 229, 197, 198; 361/104, 626, 642, 646, 837; 439/621, 622, 439/830, 890, 893, 850; 29/623
See application file for complete search history.

(56) References Cited

U.S. PATENT DOCUMENTS 5,841,338 A * 11/1998 Yasukuni ..... 337/293
5,886,611 A * 3/1999 Schaller et al. ..... 337/189
5,977,859 A * 11/1999 Kawamura et al. ..... 337/295
6,007,350 A * 12/1999 Isshiki ..... 439/76.2
6,509,824 B1 * 1/2003 Inaba et al. ..... 337/295
6,558,198 B1 * 5/2003 Kobayashi et al. ..... 439/622
6,624,356 B1 * 9/2003 Sumida et al. ..... 174/59
6,759,938 B1 * 7/2004 Matsumura et al. ..... 337/161

FOREIGN PATENT DOCUMENTS

JP 2000-133114 5/2000

* cited by examiner

*Primary Examiner*—Anatoly Vortman
(74) *Attorney, Agent, or Firm*—Finnegan, Henderson, Farabow, Garrett & Dunner, L.L.P.

(57) ABSTRACT

Disclosed is a fusible link unit having a fuse circuit structure containing screw fixing terminal portions linked through fusible members to a linking plate, and a housing into which the first fuse circuit structure is assembled, wherein a plurality of terminal supports for supporting the screw fixing terminal portions in a state that the front surfaces of the screw fixing terminal portions are exposed to outside are provided in the housing. The fusible link unit is improved in that the terminal supports of the housing each include pawl parts for preventing each screw fixing terminal portion from displacing to a surface thereof.

4 Claims, 13 Drawing Sheets

A-A

B-B

--PRIOR ART--

--PRIOR ART--

--PRIOR ART--

--PRIOR ART--

--PRIOR ART--

--PRIOR ART--

FUSIBLE LINK UNIT

The present application is based on Japanese Patent Application No. 2002-289716, the entire contents of which are incorporated herein by reference.

BACKGROUND OF THE INVENTION

1. Field of the Invention

The present invention relates to a fusible link unit with fuse circuit structures each containing terminal portions connected with fusible members, wherein the terminal portions are linked like a chain.

2. Related Art

The fusible link units of this type are generally known. (See Japanese Patent Publication No. JP-A-2000-133114, for example). FIGS. 9 through 13B shows one of such the fusible link units. The fusible link unit designated by reference numeral 100, as shown in FIGS. 9 and 10, is generally composed of first and second fuse circuit structures 101 and 102 and a housing 103 into which those fuse circuit structures 101 and 102 a reassembled. The first fuse circuit structure 101, as illustrated in detail in FIG. 11, is made up of a linking plate 104, a plurality of female terminal portions 106*a* and screw fixing terminal portions 106*b*, which are coupled through fusible members 105 to the linking plate 104, a battery terminal portion 107 extended from one end of the linking plate 104, and a common terminal portion 108 coupled through a fusible member 105*a* to the other end of the linking plate 104. The first fuse circuit structure 101 is formed by pressing a conductive plane plate.

The second fuse circuit structure 102, as illustrated in detail in FIG. 12, is made up of a linking plate 109, a plurality of female terminal portions 111*a* and screw fixing terminal portions 111*b*, which are coupled through fusible members 110 to the linking plate 109, a battery terminal portion 107 extended from one end of the linking plate 104, and a common terminal portion 112 extended from the other end of the linking plate 109. The first fuse circuit structure 101 is formed by pressing a conductive plane plate.

As shown in FIGS. 9 and 10, the housing 103 is shaped like a rectangular parallelepiped, and contains a circuit-structure accommodating chamber 114 with an opening 113 open to the upper. The housing further includes a plurality of connector housing portions 115 and a plurality of terminal supports 116, which are provided under the circuit-structure accommodating chamber 114.

As shown in FIG. 9, the first and second fuse circuit structures 101 and 102 are each inserted into the circuit-structure accommodating chamber 114, through the opening 113 of the housing 103. In this case, an extending direction of the flat surface of each fuse circuit structure is an insertion direction, and the terminal portions (106*a*, 106*b*, 111*a*, 111*b*) of the fuse circuit structure are first inserted as an insertion tip part. When the first and second fuse circuit structures 101 and 102 are completely inserted into the circuit-structure accommodating chamber, the linking plates 104 and 109 of those fuse circuit structures 101 and 102 are located within the circuit-structure accommodating chamber 114. The terminal portions 106*a*, 106*b*, 111*a*, and 111*b* are set at predetermined positions of the connector housing portions 115 and the terminal supports 116.

Next, the common terminal portions 108 and 112 of the first and second fuse circuit structures 101 and 102 are fastened together to the housing 103 by a bolt 117. The first and second fuse circuit structures 101 and 102 are electrically connected to each other to thereby form a desired fuse circuit. Connected to the female terminal portions 106*a* and 111*a* within the connector housing portions 115 are the terminals of the mating connectors (not shown). Connected to the battery terminal 107 and the screw fixing terminal portions 106*b* and 111*b* are screw fixing terminals 119 of the mating connectors by nut members 118 as press fit and screws (not shown). The terminals of the connectors (not shown) and the screw fixing terminals 119 are connected to loads by way of cables 120. Power source is distributed from a battery to those loads, through a fuse circuit. When shortcircuiting occurs in any of the loads and overcurrent flows into the related fusible member 105 (110), the fuse member burns out by heating to thereby prevent trouble by overcurrent.

In the fusible link unit 100 thus constructed, the first and second fuse circuit structures 101 and 102, shaped like flat plates, are assembled into the housing 103 to thereby form a unit. Therefore, a fuse circuit containing a number of fusible members (fuses) 105 and 110 may be made compact.

In the fusible link unit 100 mounted on a vehicle, all the terminal portions 106*a*, 106*b*, 11*a*, and 111*b* are not used in every application. In some type or grade of the vehicle to which the fusible link unit is applied, some of those terminal portions 106*a*, 106*b*, 11*a*, and 111*b* are not used. Specifically, there is a case where some of the screw fixing terminal portions 106*b* and 111*b* are not in use. In this case, the following problem arises.

As best illustrated in FIGS. 13A and 13B, each of the screw fixing terminal portions 106*b* and 111*b* is set in a state that the back surface and the sides of each screw fixing terminal portion are merely put along the terminal support 116, and the front surface of the screw fixing terminal portion is exposed to outside. Accordingly, during the assembling stage or transportation, the edge of any of the screw fixing terminal portions 106*b* and 111*b* is caught on something, the screw fixing terminal portion as caught is raised from the terminal support 116*by* its plastic deformation. In its raised state, it easily vibrates when it receives a vibration from outside, and generates rattling sounds.

One possible approach to prevent the noise sounds that result from the raising of the screw fixing terminal portion 106*b* (11*b*) and the vibration coming from outside is to fasten the screw fixing terminal portions 106*b* and 111*b*, even if not in use, by screws. However, this approach results in increase of the cost to manufacture and decrease of the efficiency of the assembling work.

SUMMARY OF THE INVENTION

Accordingly, an object of the present invention is to provide a fusible link unit which prevents the screw fixing terminal portions that are not in use from being raised and hence, prevents the rattling sounds from being generated without increasing the manufacturing cost and decreasing the assembling work efficiency.

According to the present invention, there is provided a fusible link unit having a fuse circuit structure containing a plurality of terminal portions linked through fusible members to a linking plate, and a housing into which the fuse circuit structure is assembled, wherein a plurality of terminal supports for supporting the terminal portions in a state that the front surfaces of the terminal portions are exposed to outside are provided in the housing. The fusible link unit is improved in that the terminal supports of the housing each include pawl parts for preventing each terminal portion from displacing to a surface thereof.

In the fusible link unit, even if the edge of any of the terminal portions that are not in use is caught on something, the pair of pawl parts prevent the terminal portion from being raised. Further, even if a vibration propagates to the terminal portions, the pawl parts prevent the terminal portions from vibrating by the received vibration.

In a preferred embodiment of the invention, each terminal portion includes a pair of tilting parts which extend along both sides thereof and are tilted toward the back surface of the terminal portion, and the pair of pawl parts are provided such that the pawl parts cover the pair of tilting parts, respectively.

The fusible link unit has advantages comparable with those as mentioned above, and an additional advantage that a pair of pawl parts may be provided such that the pawl parts do not protrude from the surfaces of the terminal portions.

In another embodiment, the terminal portions are a screw fixing terminal portions to which mating screw fixing terminal portions of another member are connected by nut members and screws.

In this fusible link unit, the screw fixing terminal portions are improved to have advantages comparable with those as mentioned above.

DETAILED DESCRIPTION OF THE PREFERRED EMBODIMENT

The preferred embodiment of the present invention will be described with reference to the accompanying drawings.

Figure 1:
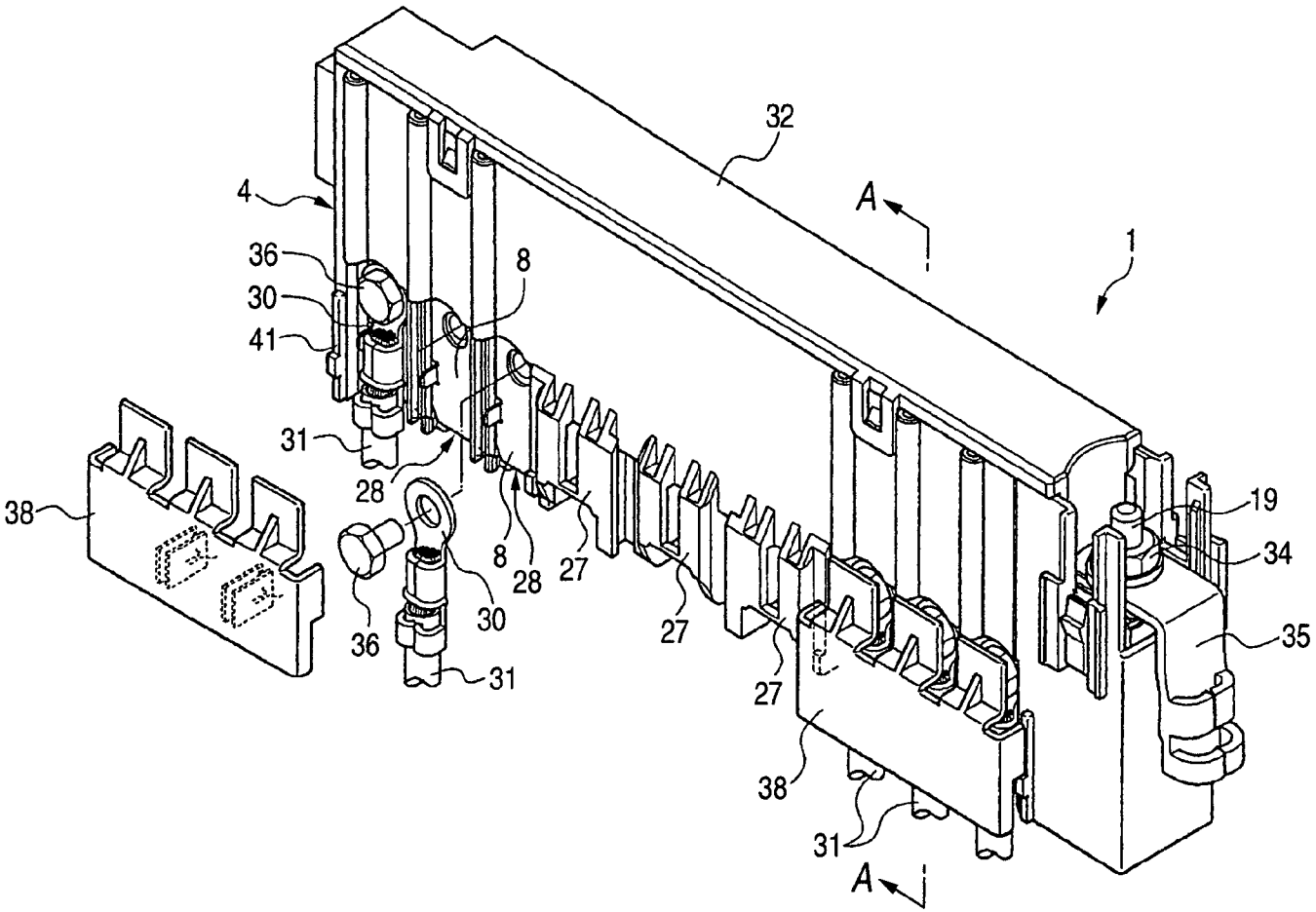
FIG. 1 is a perspective view showing a fusible link unit according to an embodiment of the invention.
Figure 2:
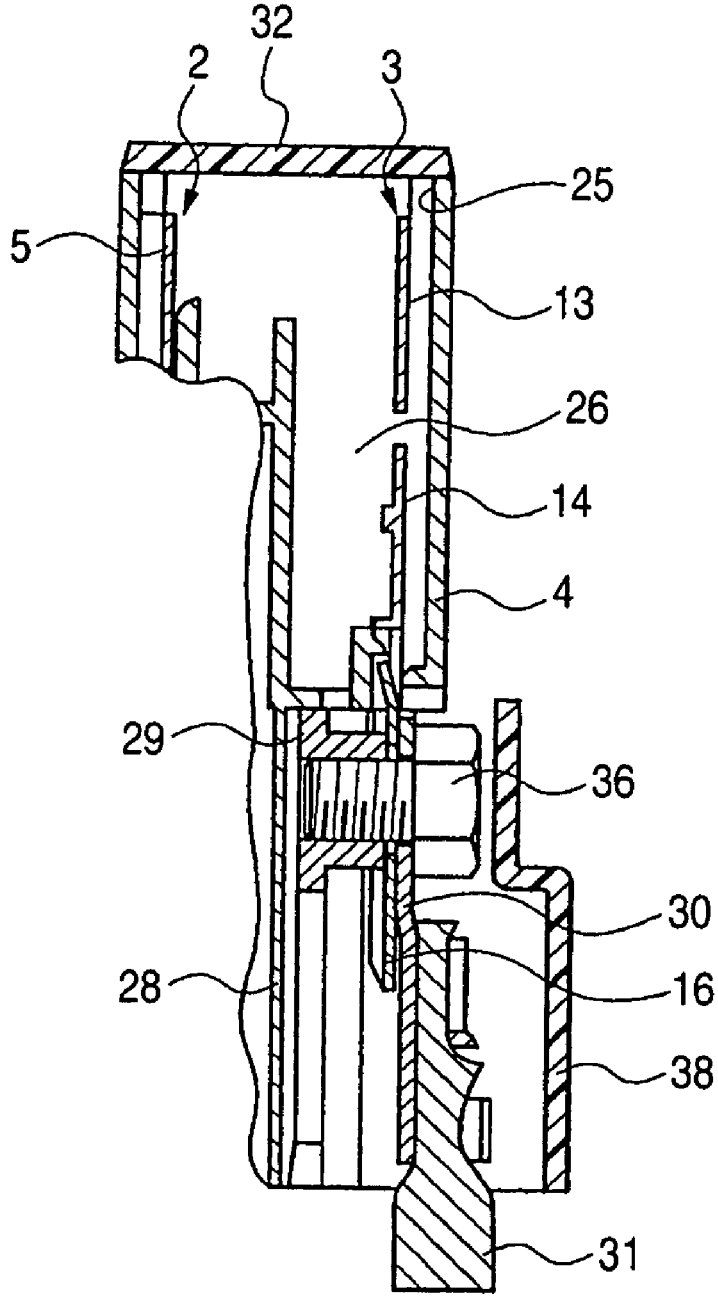
FIG. 2 is a cross sectional view taken on line A—A in FIG. 1 in the embodiment.
Figure 3:
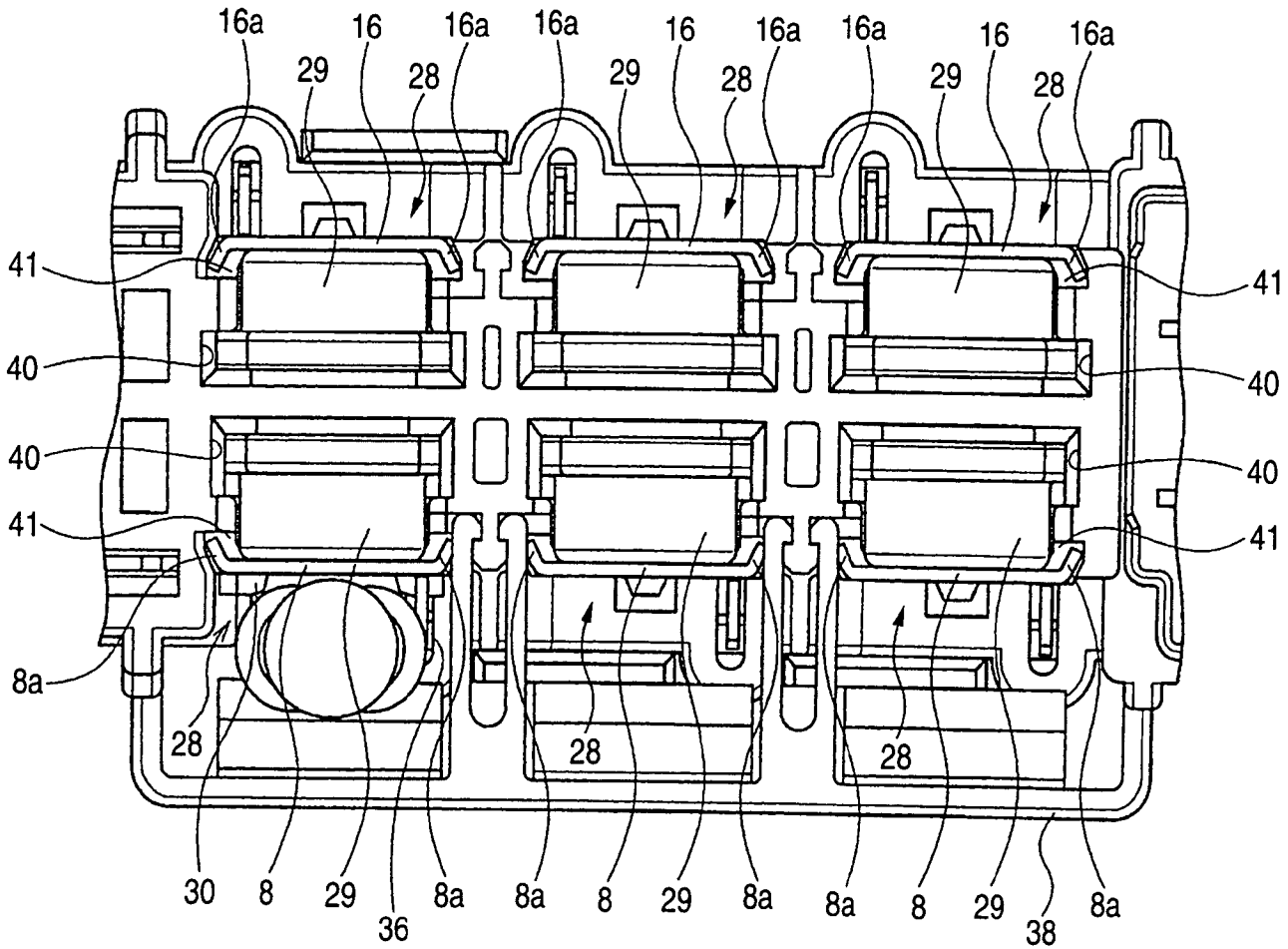
FIG. 3 is a bottom view showing terminal supports juxtaposed with each other in the embodiment.
Figure 4:
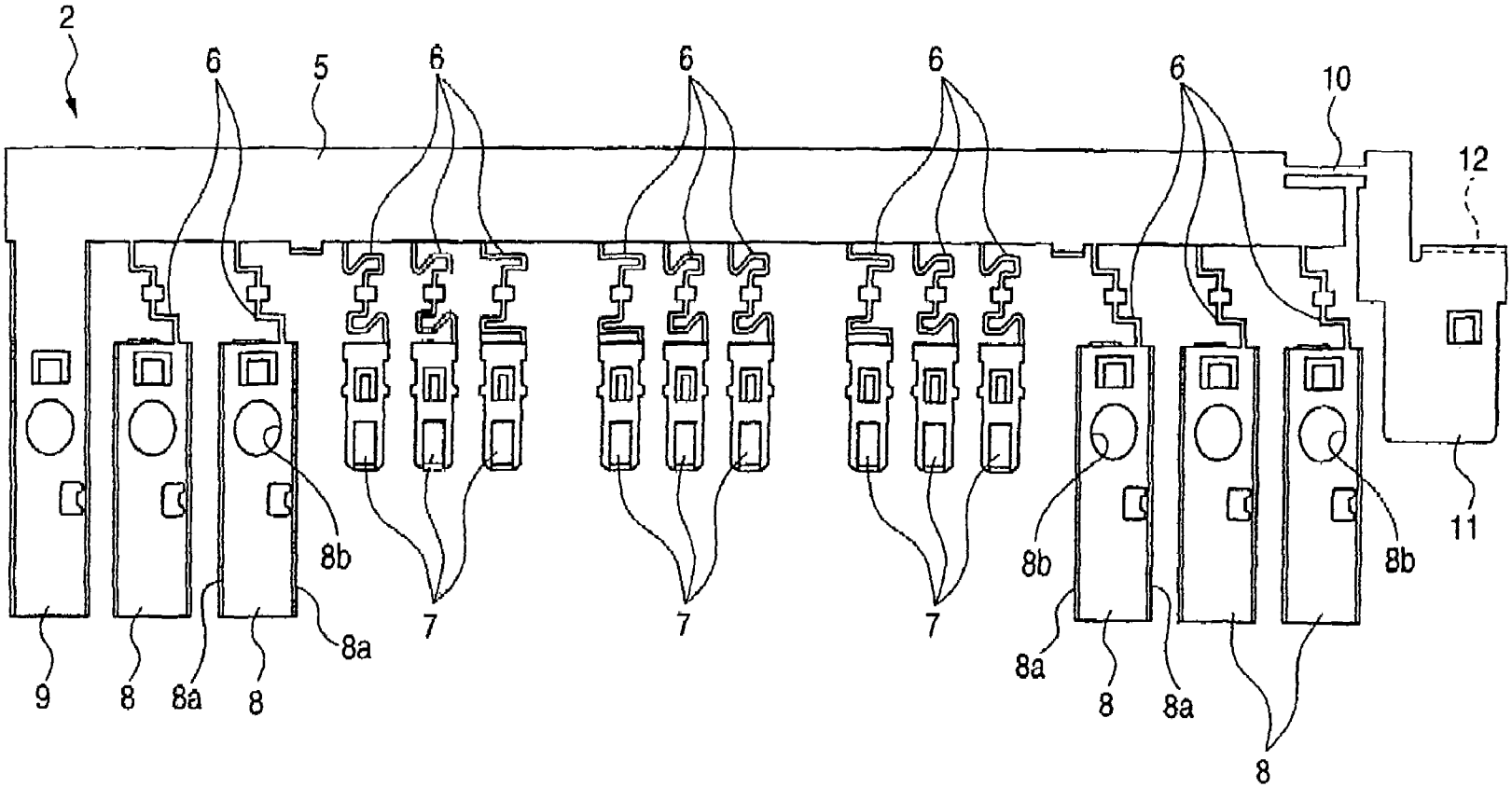
FIG. 4 is a front view showing a first fuse circuit structure in the embodiment.
Figure 5:
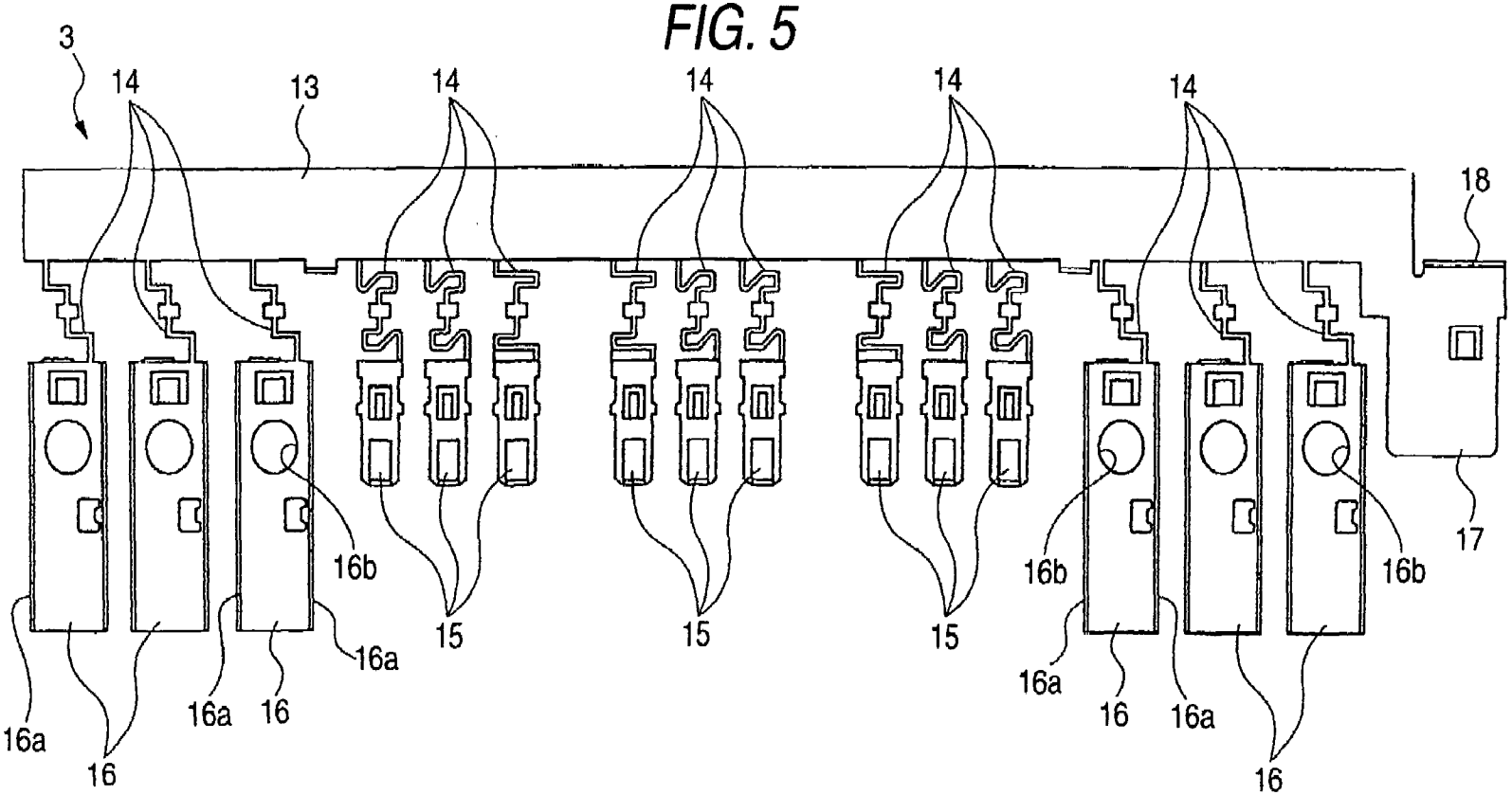
FIG. 5 is a front view showing a second fuse circuit structure in the embodiment.
Figure 6A:
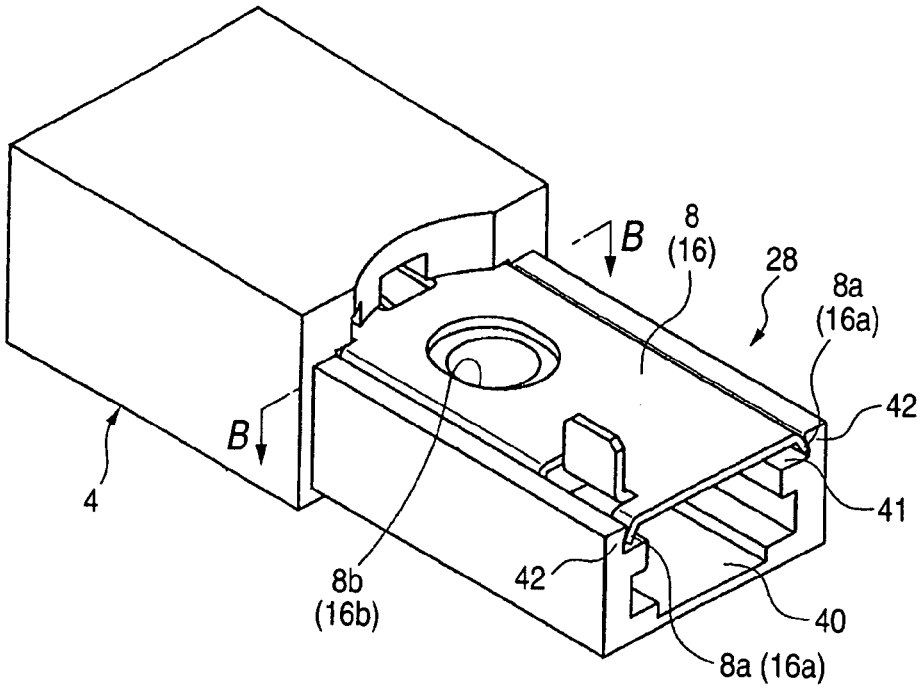
FIG. 6A is a perspective view showing the terminal supports in the embodiment.
Figure 6B:
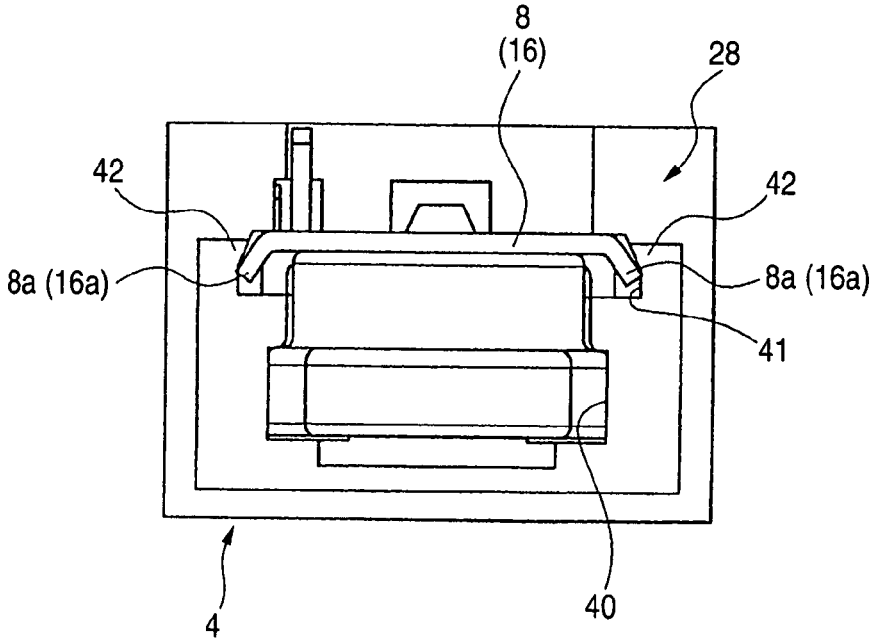
FIG. 6B is a bottom view showing the terminal support.
Figure 7A:
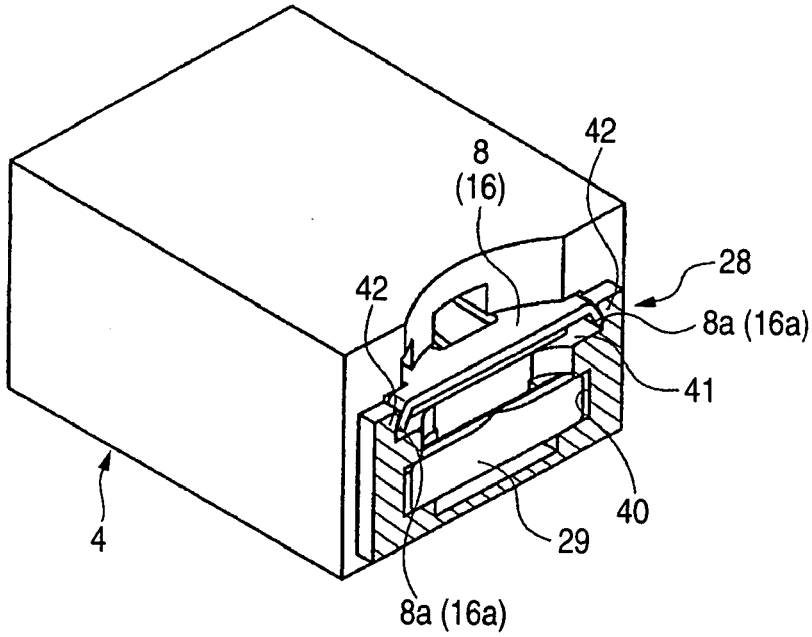
FIG. 7A is an exploded view taken on line B—B in FIG. 6A in the embodiment and FIG. 7B is a cross sectional view taken on line B—B in FIG. 6A.
Figure 7B:
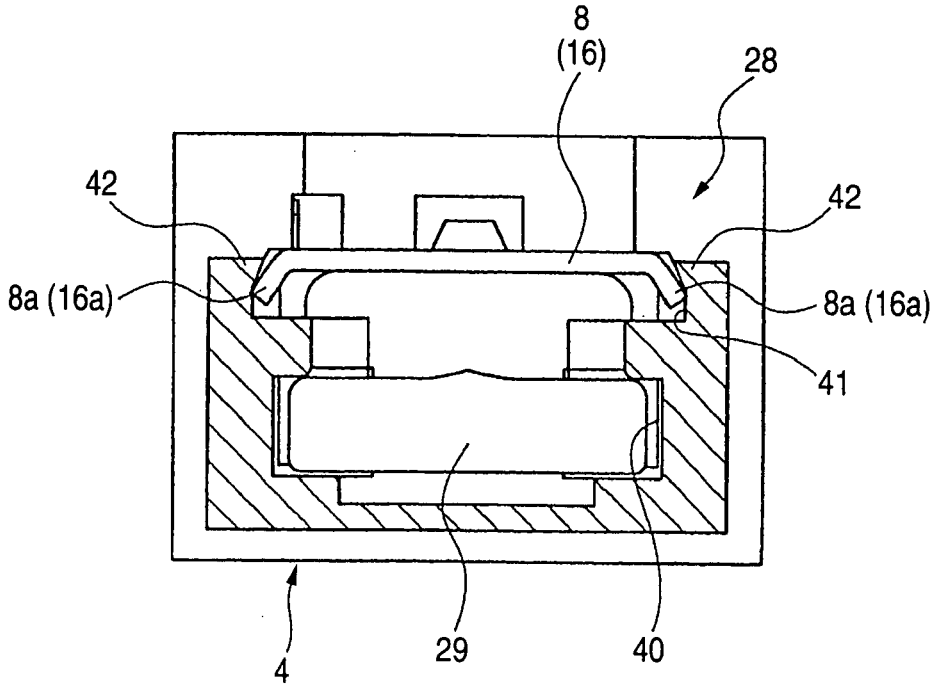
Figure 8A:
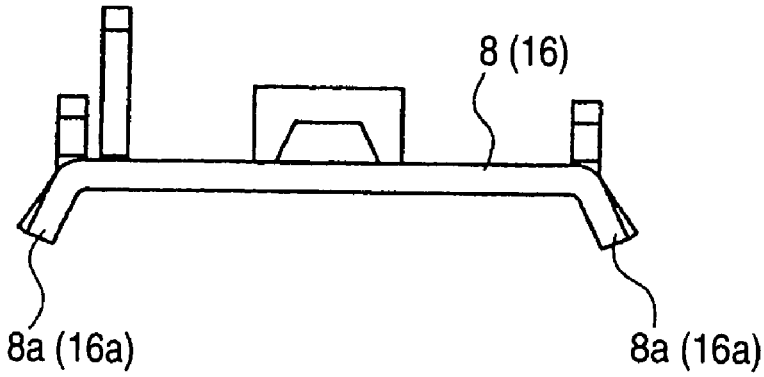
FIG. 8A is a bottom view showing a screw fixing terminal portion in each of the first and second fuse circuit structures in the embodiment.
Figure 8B:
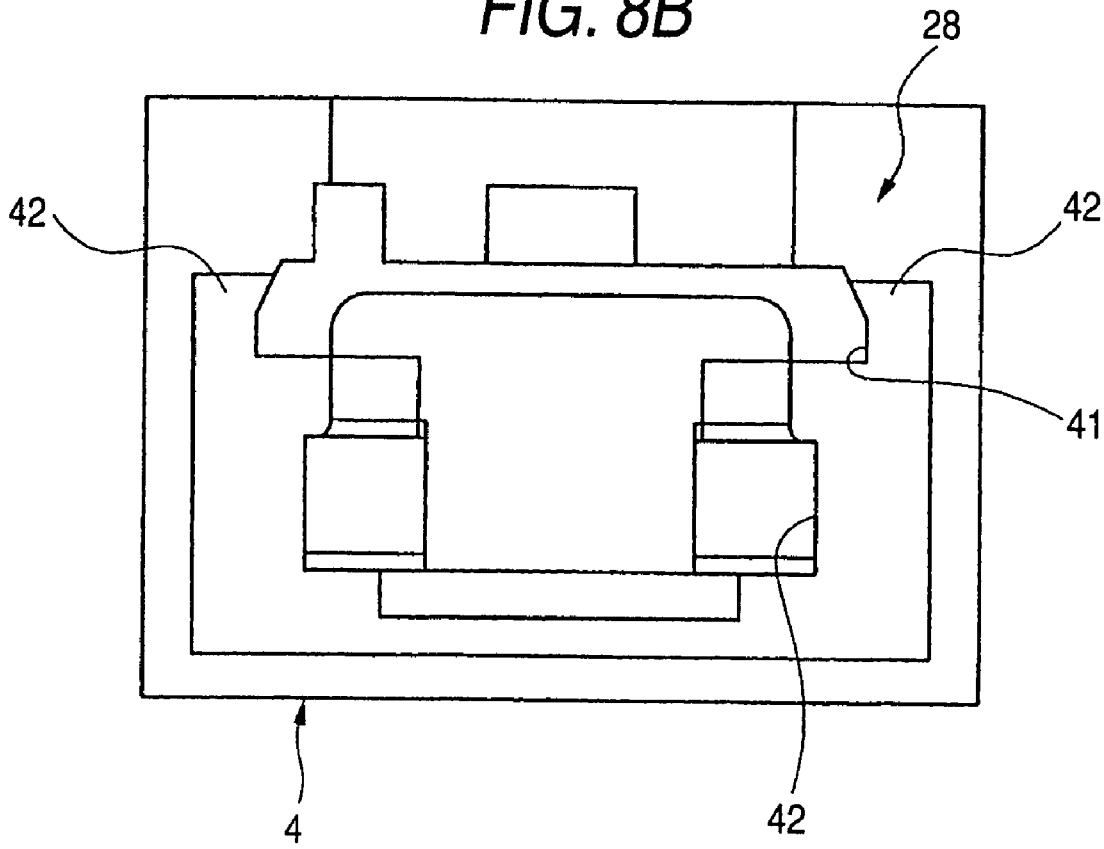
FIG. 8B is a bottom view showing a terminal support of a housing.
Figure 9:
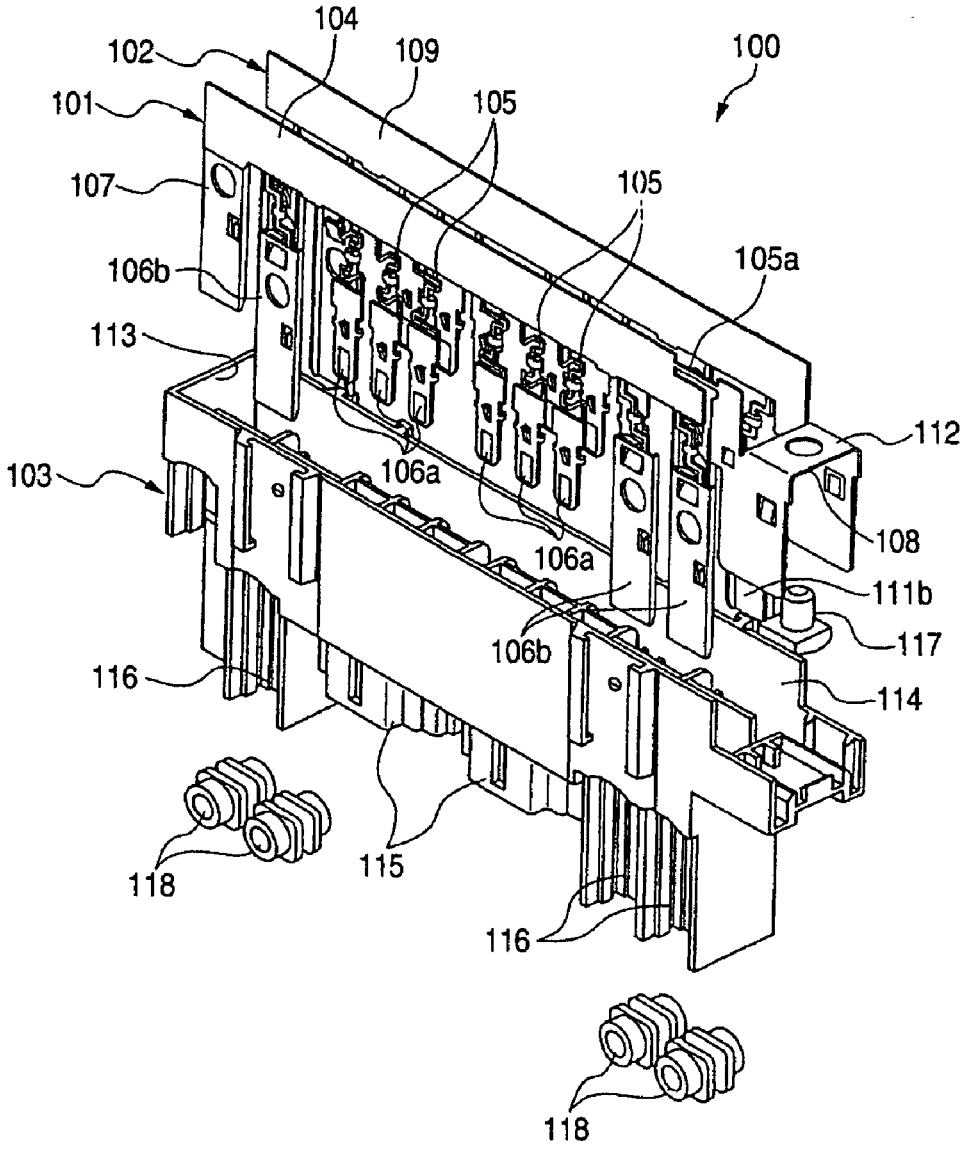
FIG. 9 is an exploded perspective view showing a conventional fusible link unit.
Figure 10:
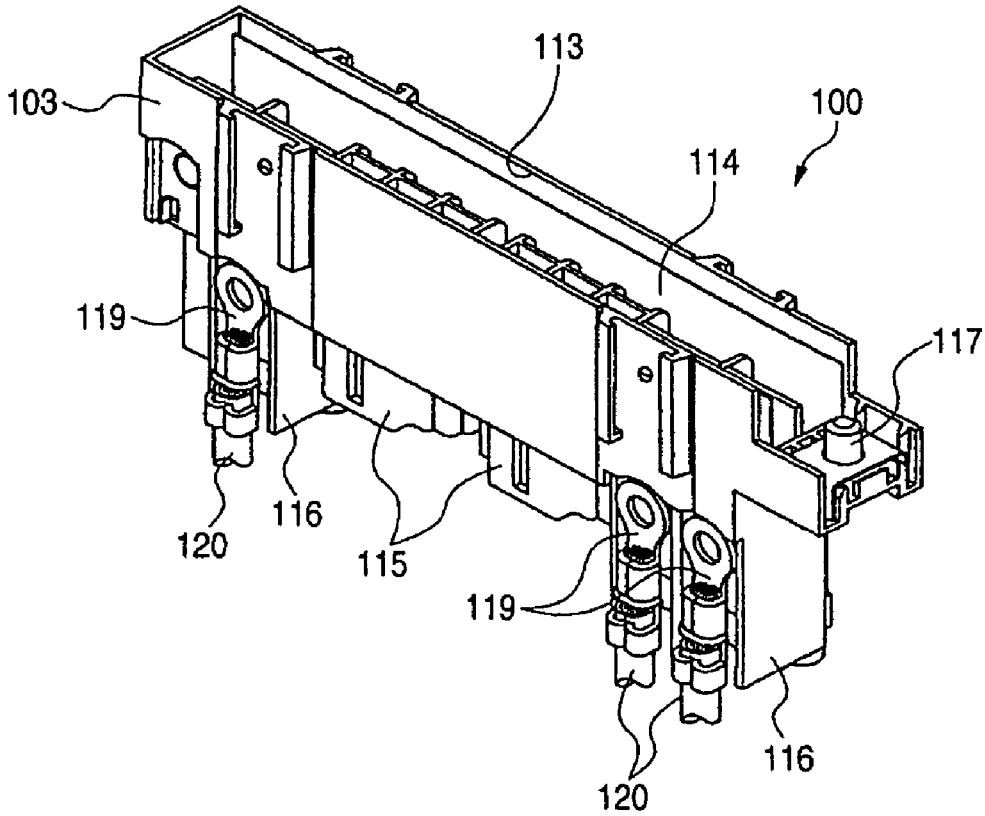
FIG. 10 is a perspective view showing the fusible link unit.
Figure 11:
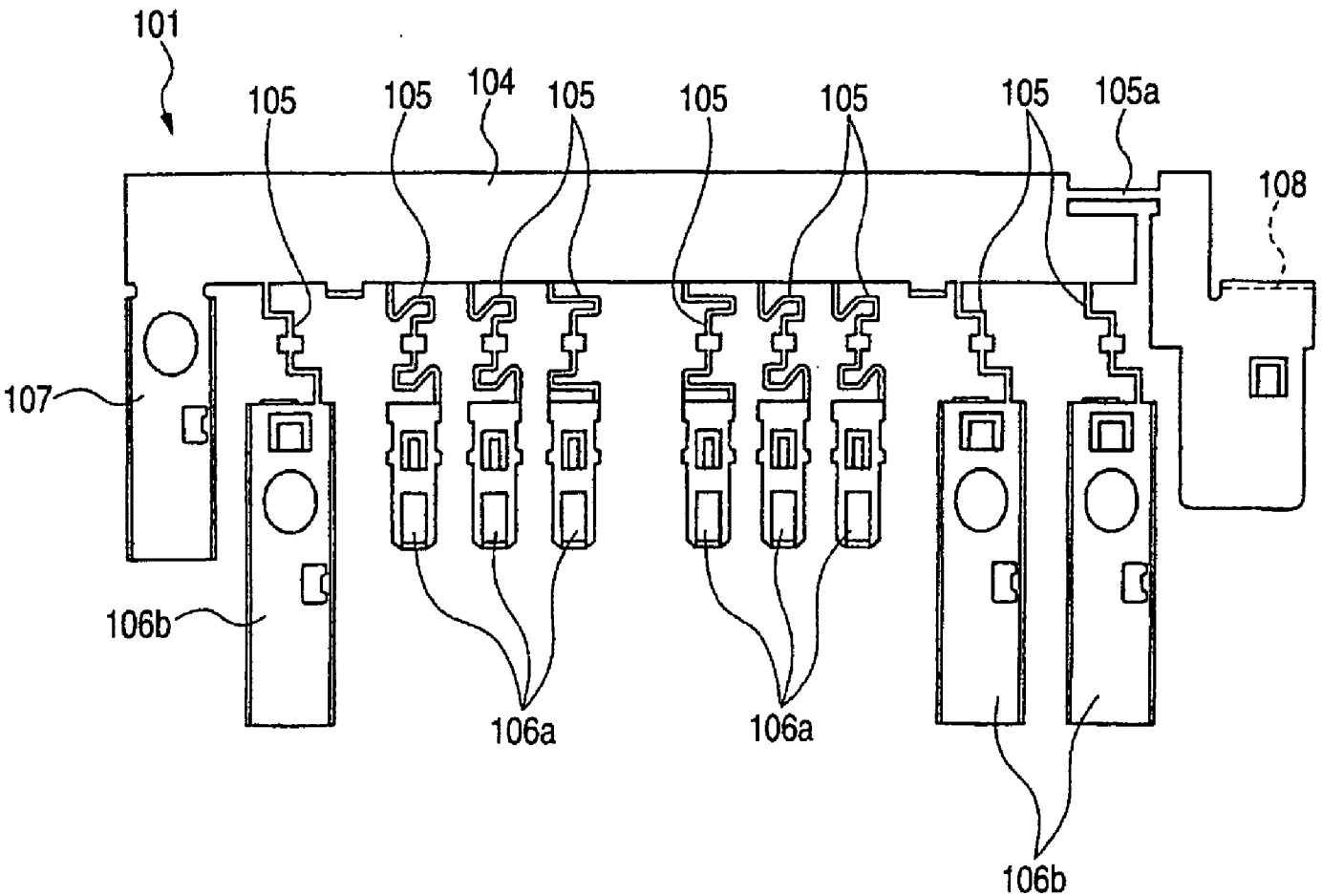
FIG. 11 is a front view showing a first fuse circuit structure of the conventional fusible link unit.
Figure 12:
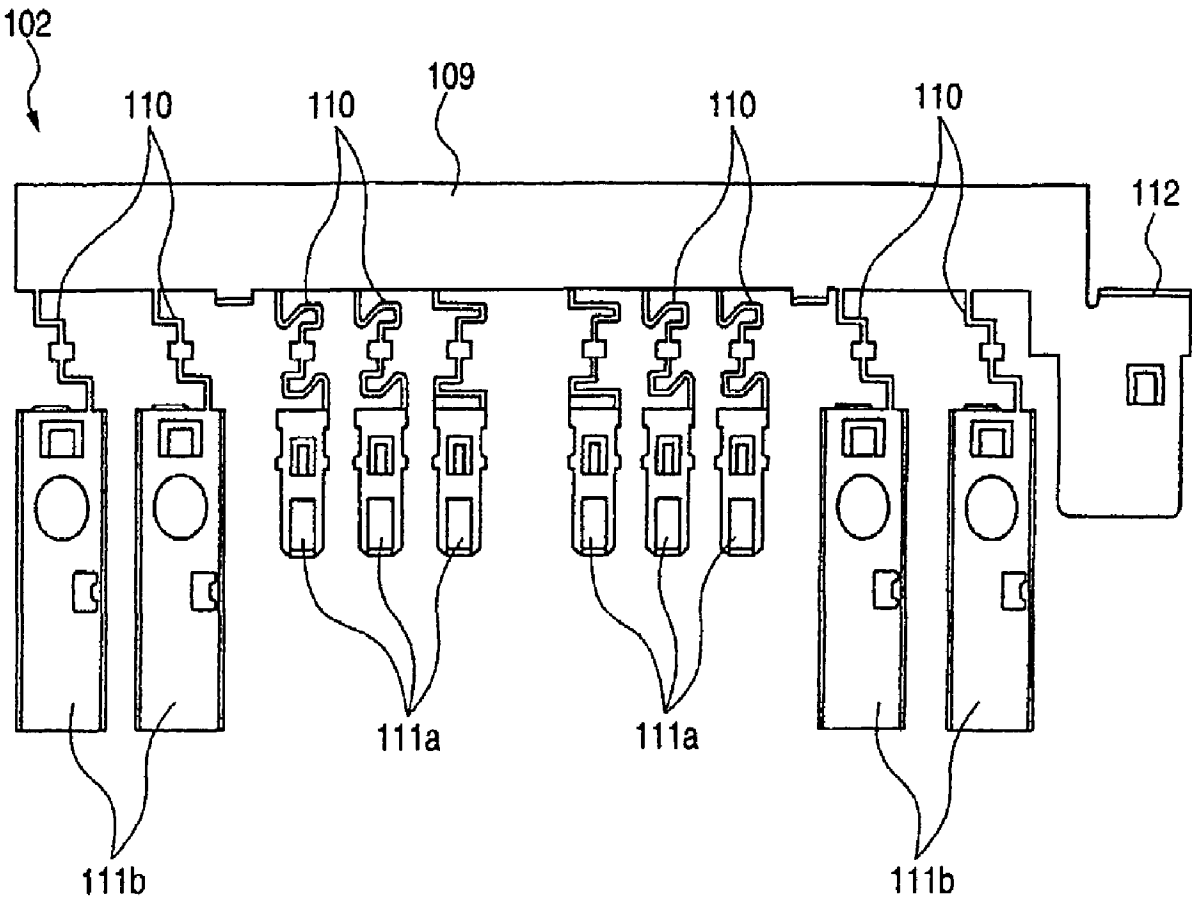
FIG. 12 is a front view showing a second fuse circuit structure of the conventional fusible link unit.
Figure 13A:
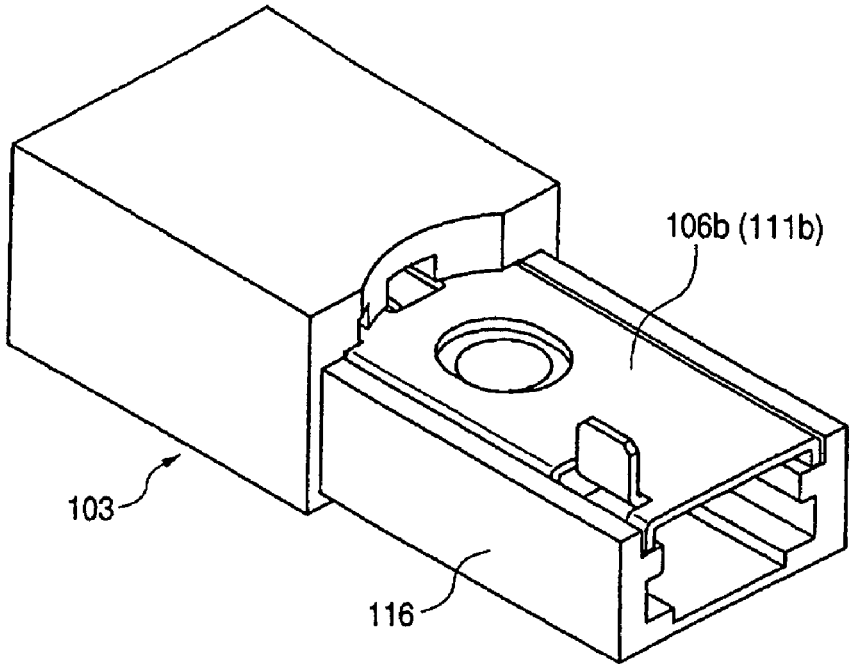
FIG. 13A is a perspective view showing a terminal support of the conventional fusible link unit.
Figure 13B:
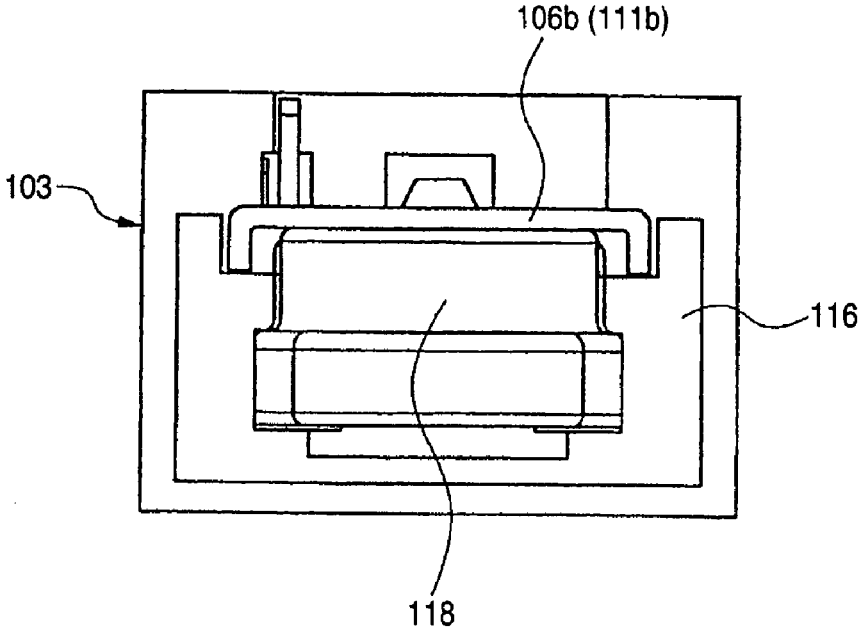
FIG. 13B is a bottom view showing the terminal support.

FIGS. 1 through 8B show the preferred embodiment of the present invention. Of those figures, FIG. 1 is a perspective view showing a fusible link unit. FIG. 2 is a cross sectional view taken on line A—A in FIG. 1. FIG. 3 is a bottom view showing terminal supports juxtaposed with each other. FIG. 4 is a front view showing a first fuse circuit structure. FIG. 5 is a front view showing a second fuse circuit structure. FIG. 6A is a perspective view showing the terminal support. FIG. 6B is a bottom view showing the terminal support. FIG. 7A is an exploded view taken on line B—B in FIG. 6A. FIG. 7B is a cross sectional view taken on line B—B in FIG. 6A. FIG. 8A is a bottom view showing a screw fixing terminal portion in each of the first and second fuse circuit structures. FIG. 8B is a bottom view showing a terminal support of a housing.

As shown in FIGS. 1 through 3, a fusible link unit 1 is generally made up of a first fuse circuit structure 2 as a bus bar, a second fuse circuit structure 3 also as a bus bar, and a housing 4 into which the first and second fuse circuit structures 2 and 3 are assembled and disposed while being spaced from each other by a predetermined distance.

The first fuse circuit structure 2, as shown in detail in FIG. 4, is made up of a narrow, cuboid linking plate 5, a plurality of female terminal portions 7 coupled through fusible members 6 to the linking plate 5 in a short side direction of the linking plate 5, a plurality of screw fixing terminal portions 8 coupled through fusible members 6 to the linking plate 5 in a width side direction of the linking plate 5, a battery terminal portion (screw fixing terminal portion) 9 coupled to the linking plate 5 directly or not through the fusible member in the width direction of the linking plate 5, and an insert lock part 11 coupled to the linking plate 5 through a fusible member 10 in the longitudinal direction of the linking plate 5. The first fuse circuit structure 101 is formed by pressing a conductive plane plate.

Each fusible member 6 is narrow and shaped like a crank, and a low melting point metal is fastened to a mid part of the crank-shaped fusible member by caulking. When current of a predetermined value or larger flows into the fusible member, the fusible member burns out. The fusible member 10 is long and straight in shape.

A plurality of female terminal portions 7 are grouped and the female terminal portions of each group are arranged side by side like a chain. A plurality of screw fixing terminal portions 8 are also grouped and arranged in a similar manner. As best illustrated in FIGS. 6A through 8B, each screw fixing terminal portion 8 includes a pair of tilting parts 8*a* which extend along both sides thereof. Those tilting parts 8*a* are formed by bending the screw fixing terminal portion 8 with respect to its central flat portion. Each tilting part 8*a* is tilted toward the rear side of the screw fixing terminal portion 8 when it is supported by the terminal support 28 of the housing 4. A screw insertion hole 8*b* is formed in the central flat portion of the screw fixing terminal portions 8. A part of the insert lock part 11 is bent perpendicularly to form a common terminal portion 12.

The second fuse circuit structure 3, as shown in detail in FIG. 5, is made up of a narrow, rectangular linking plate 13, a plurality of female terminal portions 15 coupled through fusible members 14 to the linking plate 13 in a width direction of the linking plate 13, a plurality of screw fixing terminal portions 16 coupled through fusible members 14 to the linking plate 13 in a width direction of the linking plate 13, and an insert lock part 17 extending in a longitudinal direction of the linking plate 13. The second fuse circuit structure 3 is formed by pressing a conductive plane plate.

Each fusible member 14, like fusible member 6 of the first fuse circuit structure 2, is narrow and shaped like a crank, and a low melting point metal is fastened to a mid part of the crank-shaped fusible member by caulking. When current of a predetermined value or larger flows into the fusible member, the fusible member burns out.

A plurality of female terminal portions 15, like those of the first fuse circuit structure 2, are grouped and the female terminal portions of each group are arranged side by side like a chain. A plurality of screw fixing terminal portions 16 are also grouped and arranged in a similar manner. As best illustrated in FIGS. 6A through 8B, each screw fixing terminal portion 16 includes a pair of tilting parts 16*a* which extend a long both sides thereof. Those tilting parts 16*a* are formed by bending the screw fixing terminal portion 16 with respect to its central flat portion. Each tilting part 16*a* is tilted toward the rear side of the screw fixing terminal portion 16 when it is supported by the terminal support 28 of the housing 4. A screw insertion hole 16*b* is formed in the central flat portion of the screw fixing terminal portions 16. Apart of the insert lock part 17, like that of the first fuse circuit structure 2, is bent perpendicularly to form a common terminal portion 18. The common terminal portions 12 and 18 of the first and second fuse circuit structures 2 and 3, when mounted on the housing 4, are made coherent to each other, together with a bolt 19. Both the common terminal portions 12 and 18 form an alternator terminal.

As shown in FIGS. 1 to 3, the housing 4 is shaped like a rectangular parallelepiped, and contains a circuit-structure accommodating chamber 26 with an opening 25 formed in the top end thereof. A transparent cover 32 is attached to the top of the housing 4 to thereby close the opening 25. Three connector housing portions 27 and three of terminal supports 28 are provided under the circuit-structure accommodating chamber 26. Three of juxtaposed terminal supports 28 are provided at four locations.

The female terminal portions 7 and 15 of the first and second fuse circuit structures 2 and 3 are each placed and supported at a predetermined position within each connector housing portion 27.

Each terminal supports 28 includes a nut press-fitting grooves 40 (nut receiving recesses of the invention) and a terminal slide groove 41, both being continuous to each other, as best illustrated in FIGS. 6A to 8B. A nut member 29 is press fit into the nut press-fitting groove 40, from the bottom surface side. The screw fixing terminal portions 8 (16) is slidably inserted into the terminal slide groove 41, from the top side. Each terminal support 28 immovably supports the edge parts and the side ends of the back surface of the screw fixing terminal portion 8 (16) in a state that the front surface of the screw fixing terminal portion is exposed to outside. Each terminal support 28 includes a pair of pawl parts 42 each protruding to the front surface of the related tilting part 8*a* (16*a*).

A short preventing cover 38 is detachably attached to each trio of the juxtaposed terminal supports 28. Each trio of terminal supports 28 may be covered with the short preventing cover 38.

Next, an assembling process of the fusible link unit 1 will be briefly described below. The first and second fuse circuit structures 2 and 3 are each inserted into the circuit-structure accommodating chamber 26, through the opening 25 of the housing 4. In this case, an extending direction of the flat surface of each fuse circuit structure is an insertion direction, and the female terminal portions 7, 15 and the like of the fuse circuit structure are first inserted as an insertion tip part. When the first and second fuse circuit structures 2 and 3 are completely inserted into the circuit-structure accommodating chamber, while being spaced a predetermined distance apart from each other, the linking plates 5 and 13 of those fuse circuit structures 2 and 3 are located within the circuit-structure accommodating chamber 26, as shown in FIG. 2. The terminal portions 6, 7, 15 and 16 are set at predetermined positions in the connector housing portions 27 and of the terminal supports 28.

The common terminal portions 12 and 18 of the first and second fuse circuit structures 2 and 3, together with a bolt 19, are made coherent to one another. Both the common terminal portions 12 and 18 form an alternator terminal. The first and second fuse circuit structures 2 and 3 are electrically connected through the common terminal portions 12 and 18, whereby a predetermined fuse circuit is formed.

Next, the screw fixing terminal 30 for the battery cable is connected to the battery terminal portion 9, and a screw fixing terminal 35 for the alternator cable is connected to the alternator terminal by the bolt 19 and a nut 34. Connected to the female terminal portions 7 and 15 in the connector housing portions 27 are male terminals (not shown) of the mating connector. The screw fixing terminals 30 are connected to the screw fixing terminal portions 8 and 16 of the terminal supports 28 by nut members 29 and screws 36. The male terminals (not shown) and the screw fixing terminals 30 of the mating connector (not shown) are connected to related loads by way of a cable 31.

Following the connection of the screw fixing terminals 30 and 35 of the mating connector, the transparent cover 32 and the short preventing cover 38 are attached to the housing 4.

Power source that is supplied from a battery (not shown) or an alternator (not shown) is distributed to the loads by way of the fuse circuit of the fusible link unit 1. When the output electric power of the battery (not shown) decreases to a predetermined level of electric power, the alternator (not shown) supplies electric power source to the battery (not shown) to thereby charge the battery. When shortcircuiting, for example, occurs in any of the loads and overcurrent flows into the related fusible member 6 (10, 14), which in turn burns out by heating, to thereby prevent the trouble by overcurrent.

In the fusible link unit, all the screw fixing terminal portions 8 and 16 are not used in every application. In some type or grade of the vehicle to which the fusible link unit is applied, some of those screw fixing terminal portions 8 and 16 are not used. During the assembling stage or transportation, the edge of any of the screw fixing terminal portions 8 and 16 that are not in use is caught on something, the screw fixing terminal portion as caught is raised from the terminal support 28. However, in the embodiment, the pair of pawl parts 42 prevent the screw fixing terminal portion from being raised from the terminal support. Further, the pawl parts 42 prevent the vibration of the screw fixing terminal portions 8 and 16, which is caused by the vibration from outside. Therefore, the fusible link unit of the invention can prevent the raising of the screw fixing terminal portions 8 and 16 that are not in use and the generation of the rattling sounds without increase of the cost to manufacture and decrease of the efficiency of the assembling work.

In the instant embodiment, each screw fixing terminal portion 8 (16) includes a pair of tilting parts 8*a* (16*a*) which extend along both sides thereof. The tilting part is tilted toward the back surface of the screw fixing terminal portion. The pair of pawl parts 42 are protruded such that those pawl parts cover the tilting parts 8*a* (16*a*), respectively. Accordingly, the pawl parts 42 are provided such that those pawl parts do not protrude from the surface of the tilting parts 8*a* (16*a*). Accordingly, provision of the pawl parts does not hinder the work of connecting the screw fixing terminal 30 of the mating connector. If the pawl parts 42 are provided protruding from the surface of the screw fixing terminal portion 8 (16), the surface of the screw fixing terminal portion 8 (16) is narrow because of the presence of the pawl parts 42. The screw fixing terminal 30 of the mating connector must be placed on a narrow surface of the screw fixing terminal portion, which is located between the pair of the pawl parts 42. As a consequence, the connection work is troublesome. The instant embodiment secures the surface of the screw fixing terminal portion comparable with that of the conventional fusible link unit. Accordingly, the embodiment does not hinder the connection work in any way.

While in the instant embodiment, the terminal portions are the screw fixing terminal portions 8 and 16, the invention may be applied to any structure where the surfaces of the terminal portions are supported while being exposed in the terminal supports 28.

In the embodiment mentioned above, the fuse circuit is constructed with two fuse circuit structures, i.e., the first and second fuse circuit structures 2 and 3. It is readily understood that the invention may be applied to a fusible link unit where the fuse circuit is constructed with a single fuse circuit structure or three or more fuse circuit structures.

As seen from the foregoing description, there is provided a fusible link unit having a fuse circuit structure containing terminal portions linked through fusible members to a linking plate, and a housing, wherein a plurality of terminal supports for supporting the terminal portions in a state that the front surfaces of the terminal portions are exposed to outside are provided in the housing. The fusible link unit is improved in that the terminal supports of the housing each include pawl parts for preventing each terminal portion from displacing to a surface thereof. In the fusible link unit, even if the edge of any of the terminal portions that are not in use is caught on something, the pair of pawl parts prevent the terminal portion from being raised. Further, even if a vibration propagates to the terminal portions, the pawl parts prevent the terminal portions from vibrating by the received vibration. Therefore, the fusible link unit of the invention can prevent the raising of the screw fixing terminal portions that are not in use and the generation of the rattling sounds without increase of the cost to manufacture and decrease of the efficiency of the assembling work.

In the fusible link unit, each terminal portion includes a pair of tilting parts which extend along both sides thereof and are tilted toward the back surface of the terminal portion, and the pair of pawl parts are provided such that the pawl parts cover the pair of tilting parts, respectively. The fusible link unit has advantages comparable with those as mentioned above, and an additional advantage that a pair of pawl parts may be provided such that the pawl parts do not protrude from the surfaces of the terminal portions, and hence provision of the pawl parts does not hinder the work of connecting the terminals of a mating connector in any way.

Further, in the fusible link unit, the terminal portions are a screw fixing terminal portions to which screw fixing terminal portions of a mating connector are connected by nut members and screws. In this fusible link unit, the screw fixing terminal portions are improved to have advantages comparable with those as mentioned above.

What is claimed is:

1. A fusible link unit comprising:

at least one fuse circuit structure containing a plurality of terminal portions linked through fusible members to a linking plate;

a housing into which said fuse circuit structure is assembled; and at least one terminal support for supporting a corresponding one of said terminal portions in a state that a front surface of the corresponding terminal portion is exposed from said housing, wherein said terminal support includes at least one pawl part for preventing a displacement of said corresponding terminal portion in a direction substantially normal to a surface of a corresponding terminal portion, and wherein said corresponding terminal portion includes a pair of tilting parts which is formed along both sides of said corresponding terminal portion so as to be tilted toward a back surface of said terminal portion, and a pair of pawl parts are provided in said terminal support such that said pawl parts cover said pair of tilting parts, respectively.

2. A fusible link unit according to claim 1, wherein said terminal support includes a pair of pawl parts and a pair of grooves formed along said pawl parts, and side edges of said corresponding terminal portion are entered into said pair of grooves.

3. A fusible link unit according to claim 2, wherein said corresponding terminal portion is connected to a mating terminal portion by a nut member and a screw.

4. A fusible link unit according to claim 3, wherein a nut receiving recess is formed in said terminal support.

* * * * *